US005261579A

United States Patent [19]

Propach et al.

[11] Patent Number: 5,261,579

[45] Date of Patent: Nov. 16, 1993

[54] PROCESS AND DEVICE FOR SMOOTHING TUBULAR, EXTENSIBLE MATERIAL

[75] Inventors: Hans-Walter Propach, Zell; Werner Müller, Heiningen, both of Fed. Rep. of Germany

[73] Assignee: August Krempel Söhne GmbH & Co., Fed. Rep. of Germany

[21] Appl. No.: 950,401

[22] Filed: Sep. 23, 1992

[30] Foreign Application Priority Data

Sep. 24, 1991 [DE] Fed. Rep. of Germany ..... 4131788
Sep. 24, 1991 [DE] Fed. Rep. of Germany ..... 4131789
Apr. 25, 1992 [DE] Fed. Rep. of Germany ..... 4213743

[51] Int. Cl.[5] ..... D06C 7/00

[52] U.S. Cl. ..... 223/77; 223/76; 223/75

[58] Field of Search ..... 223/75, 76, 77, 37, 223/38, 84, 60; 38/102.1; 414/225

[56] References Cited

U.S. PATENT DOCUMENTS 3,811,607 5/1974 Glaze, Jr. ..... 223/77
4,401,244 8/1983 Selvi et al. ..... 223/77
4,550,868 11/1985 Hodges et al. ..... 223/75 X
4,564,133 1/1986 Gazzarrini ..... 223/75 X
4,922,685 5/1990 Hodyes ..... 223/75 X
5,094,371 3/1992 Takumura et al. ..... 223/75 X

FOREIGN PATENT DOCUMENTS 2302758 1/1973 Fed. Rep. of Germany .
3542210 11/1985 Fed. Rep. of Germany .
236123 4/1985 German Democratic Rep. .
48512 12/1985 Japan ..... 223/75
2081321 7/1981 United Kingdom .
2181465 9/1986 United Kingdom .

*Primary Examiner*—Clifford D. Crowder
*Assistant Examiner*—Bibhu Mohanty
*Attorney, Agent, or Firm*—Harness, Dickey & Pierce

[57] ABSTRACT

A process and a device for smoothing tubular, extensible material with at least one closed end, especially for shaping stockings or tights, is described, with at least one apparatus to feed in and stretch the material on an elongated stretcher being provided, also with at least one apparatus to heat the material on the stretcher, such that the apparatus for feeding in and stretching the material has a gathering fixture to pre-gather the material and a stretching apparatus that has gripper elements to transfer the gathered-up material from the gathering fixture, that can be moved along the elongated stretcher in order to slip the gathered material onto the stretcher. This arrangement guarantees particularly gentle handling of the material, and uniform stretching on the stretcher.

27 Claims, 8 Drawing Sheets

PROCESS AND DEVICE FOR SMOOTHING TUBULAR, EXTENSIBLE MATERIAL

The invention concerns a process for smoothing tubular, extensible material with at least one closed end, especially for shaping stockings or tights, in which the material is slipped onto an elongated stretcher, treated with heat, and lastly pulled off the stretcher.

The invention further concerns a device for smoothing tubular, extensible material with at least one closed end, especially for shaping stockings or tights, with means for feeding and stretching the material on an elongated stretcher, and with heating means for heating the material on the stretcher.

When they are manufactured, stockings or tights undergo a dyeing process in which the fabric can shrink, and which at least in some cases causes the fabric to stick to itself, so that the stockings are crumpled together.

In order to bring the stockings into a smooth state suitable for the consumer, they must therefore first be pulled onto a stretcher, and then subjected to a heat treatment in order to relax the stockings. Conventionally, the stockings are first pulled, from top to bottom, onto two U-shaped frames.

Then the stockings are subjected, in front of a light box, to a visual inspection for defects. The stockings then pass in the conventional manner into a heating chamber, in which they are briefly heated to temperatures above those of the previous dyeing process, in other words to a temperature of approximately 100 to 110 degrees C. This relaxes the stockings in order to smooth them out.

From the heating chamber, the stockings are moved to a pull-off station at which the stockings are pulled off the frames.

From here the stockings are, in the conventional manner, transferred by means of a conveyor belt or the like to a packaging machine, in which the stockings are packaged for sale.

With an arrangement of this kind, the speed with which the stockings pass through the shaping machine is very low. Since the stockings must be manually pulled onto the U-shaped frames by an operator, this greatly reduces the cycle speed. Since the stockings are exposed to severe local tensile stresses while being pulled onto the U-shaped frames, they must be pulled on relatively slowly in order to prevent tearing of the stockings.

Moreover, the action of pulling the stockings onto the frames from top to bottom leads to symptoms of fatigue in the operator after only a relatively short time.

The conventional arrangement also has the disadvantage that the stockings are pulled off the frames and transported to the downstream packaging machine while they are still warm. This leads to subsequent shrinkage effects and to changes in shape, so that the size consistency of the stockings is degraded, and correct positioning in the retail packaging can no longer be guaranteed.

GB-A-2,181,465 has disclosed a device and a process for smoothing tights in which the tights are first subjected to a visual check in front of a large-area light source in an inspection apparatus, and then are automatically transferred from that inspection apparatus to a shaping device in which the tights are subjected to a heat treatment in order to produce smoothing.

In the known arrangement, the tights are pulled onto an elongated stretcher, which consists of two flat strips arranged next to one another, by means of endless belt drives. The belt drives are integrated into the flat strips in such a way that stub segments project laterally beyond the narrow end surfaces, and thus after a pair of tights has been placed on the end of the flat strip, the tights are completely stretched, by the circulating stub segments, onto the two adjacent flat strips. To allow transfer to the shaping apparatus after passing through the inspection apparatus, U-shaped holders are inserted into the tights from their open end and moved along the strips in order to slip the tights from the flat strips onto the two holders and gather them up. From the two holders, the tights are then transferred onto essentially U-shaped frames of the downstream stretching apparatus, for which purpose the holders are moved along the frames.

With this arrangement, the fact that the stockings must first be completely stretched onto a flat, elongated stretcher, then removed from this stretcher, and lastly transferred onto another stretcher, has proved to be disadvantageous. The very first stretching operation, which is performed by means of elongated belt drives integrated into the stretcher, can result in damage to the tights, since they can be overextended while being stretched on the stretcher. Another disadvantage becomes apparent when transferring the tights from the elongated stretcher by slipping them onto the holders, achieved by moving them, starting at the open end of the tights, along the two flat strips. Here there is a danger of severe local stresses on the tights, so that overextension and the appearance of damaged areas cannot be ruled out. There is also a risk of direct mechanical damage to the tights, since the holders must be moved directly along the elongated flat stretchers. Lastly, the known arrangement is of extremely complex design, and requires numerous moving parts including a cam mechanism.

The underlying object of the invention is therefore to create a device and a process for smoothing tubular, extensible material with at least one closed end, especially for shaping stockings or tights, which essentially rules out damage to the material and guarantees problem-free operation. In particular, the process is intended to allow the simplest possible operating sequence, and the device is intended to guarantee the simplest possible configuration and problem-free operation.

According to the invention, this object is achieved by a device for smoothing tubular, extensible material with at least one closed end, especially for shaping stockings or tights, with means for feeding in and stretching the material on an elongated stretcher; and with heating means for heating the material on the stretcher, with the means for feeding in and stretching the material having a gathering fixture to pre-gather the material and a stretching means that has gripper elements to transfer the gathered material from the gathering fixture, that can be moved along the elongated stretcher in order to slip the gathered material onto the stretcher.

The object is also achieved by a process for smoothing tubular, extensible material with at least one closed end, especially for shaping stockings or tights, in which the material is first pulled at one open end onto a gathering fixture, and then gathered up on it; then taken from the gathering fixture, slipped onto a elongated stretcher, and treated with heat; and lastly pulled off the stretcher.

According to the invention, the extensible material is therefore not directly stretched on the stretcher, but rather is first pulled, in a spatially separated manner, onto a gathering fixture, for which purpose one open end thereof simply needs to be placed manually onto the end of the gathering fixture. Then the extensible material is pre-gathered on the gathering fixture, then taken from the gathering fixture, and lastly slipped onto the elongated stretcher. Because the material is pre-gathered on the gathering fixture, which can be done gently, the material is pulled onto the elongated stretcher during the subsequent slipping-off process in an extraordinarily gentle and uniform manner. The apparatus needed in this case to transfer the pre-gathered material from the gathering fixture, and then to slip it onto the elongated stretcher, can have a particularly simple configuration, and simply requires gripper elements that can take the gathered material from the gathering fixture and then can be moved lengthwise along the elongated stretcher in order to slip the gathered material onto it.

Since the material is merely pre-gathered by the gathering fixture and is not at the same time completely stretched, non-uniform stress and overextension during this procedure are largely eliminated.

The actual result of this is that with the process and the device according to the invention, the risk of damage when stretching the material on the stretcher is greatly reduced compared with conventional processes and devices.

In an advantageous development, the gripper elements in the device according to the invention can be laterally inserted at least partly into the gathering fixture, and can be spread out away from one another in order to transfer the gathered material.

This results in a simple configuration and a simple movement sequence when the pre-gathered material is transferred from the gathering fixture by the gripper elements.

In an additional development of the invention, at least one gripper element is arranged so it can be tilted with respect to the other gripper element.

It has been found that the use of gripper elements that can be tilted with respect to one another allows the material to be stretched particularly uniformly on the stretcher. In contrast to gripper elements parallel to one another, transfer of the gathered material onto the stretcher can be controlled by the tilting process. This largely eliminates non-uniform stress on the extensible material and non-uniform stretching. The particularly uniform stretching of the material guarantees that a visual inspection for defects can easily be performed later with no need for transfer to another stretcher in order to do so, as with the conventional procedure.

In an advantageous development of the invention, each tiltable gripper element can be tilted against a stop element so that the gathered material is held between gripper element and stop element, and is not released for transfer onto the stretcher until the gripper element has been moved into a position parallel to the other, nontiltable gripper element.

The stop element limits the tilting angle of each tiltable gripper element, thus preventing overextension of the material by excessive tilting, and thus also preventing local overspreading. Moreover, the gathered-up material is in each case clamped between the gripper element and the stop element as soon as a tiltable gripper element contacts the stop element. This prevents premature slippage of multiple layers of the gathered material when it is slipped off onto the stretcher.

In an advantageous development of the invention, each tiltable gripper element can be alternately tilted against the stop element and moved into a position parallel to the other gripper element, while the gripper elements are moved relative to the stretcher, in order to slip the gathered material onto the stretcher beginning with the closed end.

This periodic tilting of the gripper elements with respect to one another means that the gathered material is slipped onto the stretcher in a particularly gentle manner. Furthermore, the material is especially uniformly stretched, since irregularities are automatically compensated for by the periodic tilting.

In an advantageous development of the invention, an actuating means is provided for tilting said tiltable gripper elements at a tilting frequency which can be controlled as a function of the relative velocity between the gripper elements and stretcher. Since it is possible to proceed at different relative velocities, depending on the material, when the material is slipped onto the stretcher by the gripper elements, this makes it possible to achieve particularly uniform and gentle stretching for a variety of materials.

In a further embodiment of the invention, two outer gripper elements that have a gripper finger are arranged in a tiltable manner on either side of a central, essentially U-shaped gripper element whose two limbs are configured as gripper fingers.

Configuration of the gripper elements as fingers means that the gathered-up material can be slipped off onto the stretcher in a particularly gentle manner; it also becomes easier to remove the gathered material from the gathering fixture, since the gripper elements can, for example, penetrate laterally into corresponding openings in the gathering fixture.

In an advantageous manner, two outer, finger-like, tiltable gripper elements and one central, essentially U-shaped gripper element can be used to remove tights that have been gathered up on two gathering fixtures arranged side by side, and then stretch them on two stretchers.

In a development of the invention, each stop element is designed as a rubber bumper.

This not only prevents damage to the gathered-up material when a gripper element is tilted against the stop element, but also produces good adhesion, so that even slight pressure will prevent unintentional release of various layers of the gathered-up material when it is being slipped onto the stretcher.

In a further embodiment of the invention, the gathering fixture has two plates spaced away from one another, between which are arranged belt drives with endless circulating belts which project at least partially outward beyond the plates.

With the belt drives, the extensible material can be gathered up in a reliable manner without requiring a precisely defined position for the material when it is previously stretched manually onto the lower end of the gathering fixture.

The open end of the leg of the extensible material—for example a womans stocking—is simply pulled onto the lower end of the gathering fixture. Brief activation of the belt drive is sufficient to gather up the stocking completely in a gentle manner.

In a preferred development, two double belt drives are provided in this arrangement, with each double belt drive having two belts parallel to one another, each running in a direction opposite to the belts of the other double belt drive.

This embodiment results in particularly uniform gathering of the material, since even material that is placed non-uniformly on the gathering fixture is uniformly transported by the total of four outer stub segments.

In an additional development of the invention, guide rails, on which the belts are guided so as to project in part outward beyond the long-side end surfaces of the plates, are provided between the plates.

This feature further increases frictional engagement between the belts and the material being gathered.

If the extensible material consists of womens stockings or tights, it is advantageous if the stretcher has at least one frame bent essentially into a U shape.

This results in particularly good adaptation to the shape of the stockings or tights, promoting uniform pulling onto the stretcher. If tights are to be processed, it is advantageous if two such U-shaped frames are provided next to one another in a aligned arrangement.

In a further advantageous embodiment of the invention, a carousel that can rotate about its vertical axis is provided, on which are arranged a plurality of stretchers, with the feeding and stretching apparatus and the heating apparatus being designed as separate stations between which the carousel can be rotated.

A particularly space-saving configuration and simple, stepwise operation of the device according to the invention can be achieved with this kind of arrangement. A plurality of such devices can be linked together, for example by means of conveyor belts placed between them, in order to increase capacity.

In order additionally to allow the material to be pulled off the stretchers automatically, it is advantageous the heating station to be followed by a pull-off station to pull the material off the stretcher.

In a further advantageous embodiment of the invention, the frames are suspended from the carousel, with their rounded portion facing downward.

Fatigue symptoms in an operator are effectively eliminated by the fact that the extensible material can be pulled onto the gathering fixture directly at grasping height at the feeder station, with the stretching process then being performed automatically.

In a further embodiment of the invention, after being stretched on the frames, the stockings are moved back to the feeder station for a visual inspection for defects in front of a large-area light source, thus allowing a visual inspection while simultaneously the next item, i.e. for example the next pair of tights, can already be pulled onto the frame.

In a further advantageous embodiment of the invention, the frames are fastened to the carousel by means of a frame receptacle so as to pivot between a mutually aligned arrangement and an arrangement displaced laterally out of alignment.

This guarantees very smooth stretching for tights, even in the gusset region. In this manner the gusset is stretched three-dimensionally into approximately a saddle shape, so that the gusset is held completely under tension between the two frames. As a result, a pair of tights can be also subjected to a reliable visual check for defects in the gusset region as well, while with a conventional arrangement a visual inspection is not possible because of the wrinkled fabric in the region of the gusset.

In an advantageous embodiment of the invention, the frames can be pivoted along a long axis of the frames parallel to one another in order to pull off the material, and the pull-off station has two pull-off belts which, in order to pull the stockings off the frames, can be brought laterally against the frames.

This guarantees that the material is pulled gently off the frames.

In an advantageous development of the invention, the pulloff belts are followed by a folding means for folding the material transversely.

Since, according to this proposal, the folding means for transversely folding the material follows immediately after the pull-off belts, any change in the position of the material in the folding means is excluded, since the material is still partly held between the pull-off belts during the folding process. The material is therefore still under tension when transverse folding has begun. This ensures that the material lies smoothly during folding, and is folded correctly.

The folding means can have parallel belts to transport the material, between which a folding slider can be inserted laterally.

This makes it possible to ensure correct positioning of the folding edge when tights or stockings are folded.

In an additional development of the invention, the folding means has a package liner feeder to feed in a package liner.

Since in this manner the material is folded around a package liner, the material is fixed in the correct position while still under tension, so that later changes in the shape and position of the material, as well as shrinkage, are completely excluded.

It is understood that the features mentioned above and those yet to be explained below can be used not only in the respective combinations indicated, but also in other combinations or in isolation, without leaving the context of the present invention.

Further advantages are evident from the description below of an exemplary embodiment of the invention, with reference to the drawings, in which.

Figure 1:
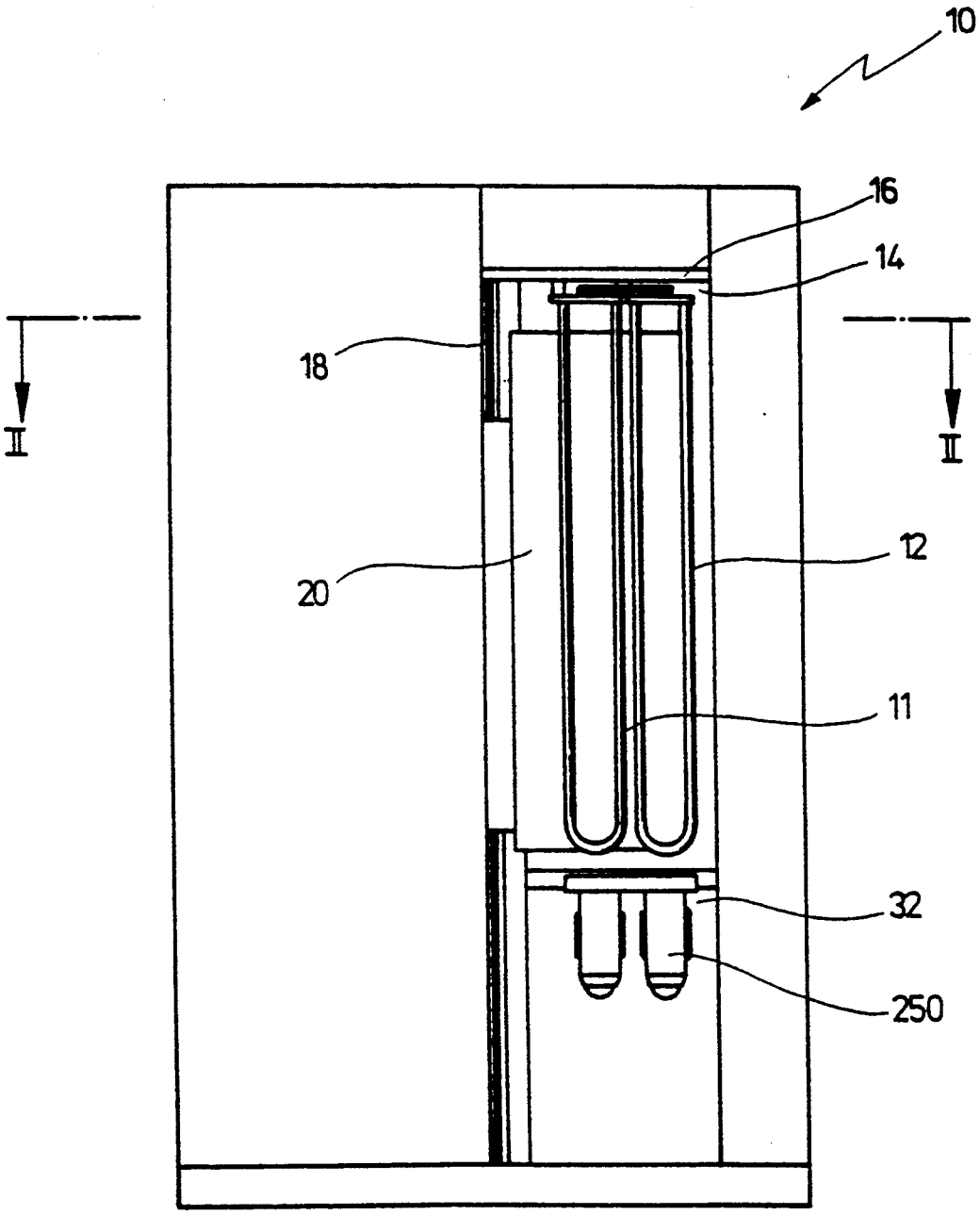
FIG. 1 shows a simplified front view of a device according to the invention.
Figure 2:
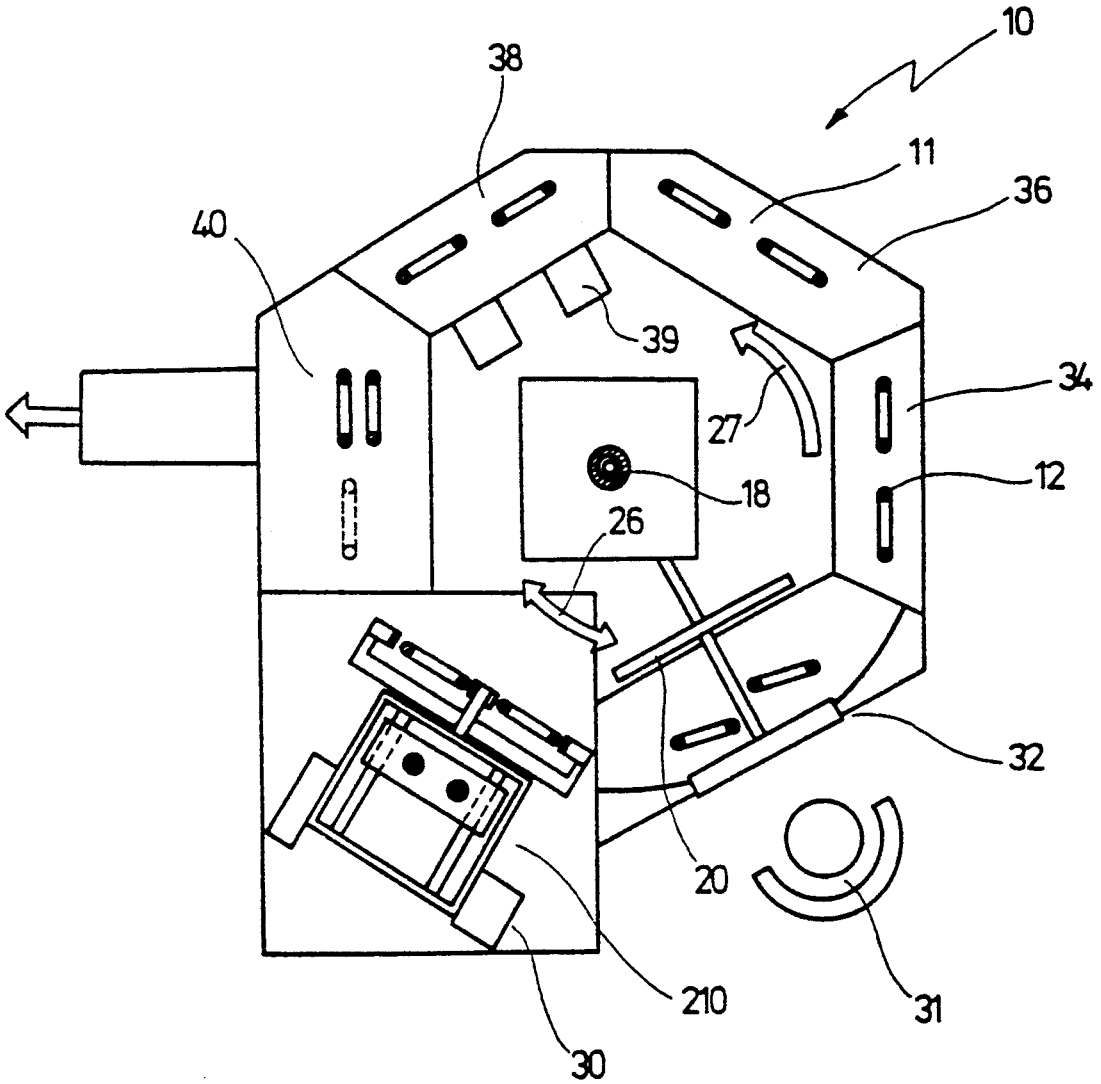
FIG. 2 shows a section along line II—II through the device according to FIG. 1, in a simplified depiction.

In FIGS. 1 and 2, a device according to the invention is labeled as a whole with the number 10.

This device is suitable for shaping tubular, extensible material with at least one closed end, especially for shaping tights, but could also, with suitable adaptation, be used for other materials, especially for individual stockings, since the latter are generally shaped and then packaged in pairs. Hereinafter, the device and the process according to the invention will be described using the example of a pair of tights 100 that has two closed ends 222 or legs, and one open end 221 at the waistband.

The device has a total of six stations through which the tights pass. Provided at a central, vertical rotation axis 18 is a carousel 16, on which stretchers 11 consisting of two frames 12 for stretching tights 100 are arranged next to one another, each offset at a 60-degree angle from one another. The frames 12 consist of round bars that are bent into a U shape and are arranged suspended from a frame receptacle 14 with their round end pointing downward. By means of the frame receptacle 14, the frames 12 can, in a manner not explained further, be either oriented in alignment with one another; pivoted with respect to one another laterally out of alignment, about their long axis; or folded out parallel to one another.

The tights 100 are stretched onto the frames, and once on them are moved on in steps from station to station, in each case by a 60-degree rotation of the carousel 16.

A feeder station 32, in which the tights are pulled onto two gathering fixtures 250, is provided in order to feed in the tights.

From the feeder station 32, the gathering fixtures 250 can be rotated through an angle of approximately 60 degrees clockwise to a stretching station 30, as indicated by the arrow 26. The stretching station 30 has a stretching apparatus 210 by means of which the tights are taken from the gathering fixtures and then automatically stretched onto the frames 12, as explained in more detail below with reference to FIGS. 5 to 7.

The tights are first pulled onto the gathering fixtures 250 at the feeder station 32, then rotated counterclockwise to the stretching station 30 and stretched onto the frames 12 by means of the stretching apparatus 210. Once the stretching procedure is complete, the tights are moved by a rotation of the carousel 16 back to the feeder station 32, where they are subjected to a visual inspection for defects in front of a large-area light source 20.

This movement sequence makes it possible to pull new tights onto the gathering fixtures 250 at the feeder station 32, while at the same time tights stretched on the frames 12 are being subjected to a visual inspection; this results in a considerable time savings. With a further rotation of the carousel 16 counterclockwise in the direction of arrow 27, the tights 100 are transported to a first heating apparatus 34, from which they pass to a second heating apparatus with a further rotation through 60 degrees. With a further movement through 60 degrees in the direction of arrow 27, the frames 12 with the tights stretched on them are rotated to a cooling station 38, in which the tights are cooled with fans 39. Then the tights stretched on the frames 12 reach a pull-off station 40 by means of a further rotation of the carousel.

At the pull-off station 40, the stockings are pulled off the frames 12, which with a further rotation of the carousel 16 in the direction of the arrow 27 move back to the stretching station 30.

Details of the gathering fixture 250 and of the stretching apparatus 210 are evident from FIGS. 5 to 8.

Figure 4:
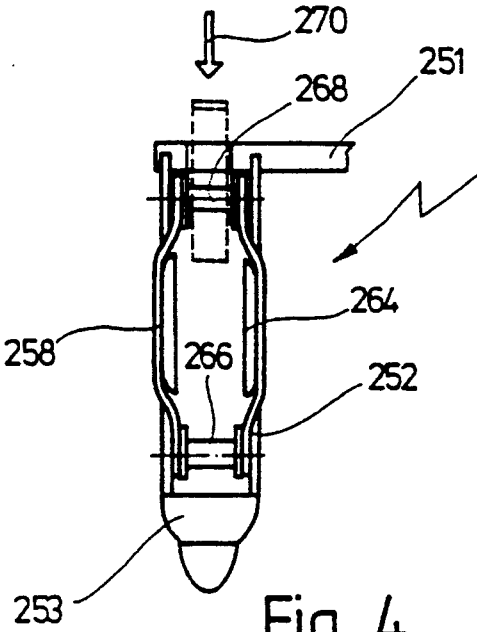
FIG. 4 shows a side view of the arrangement according to FIG. 3.
Figure 3:
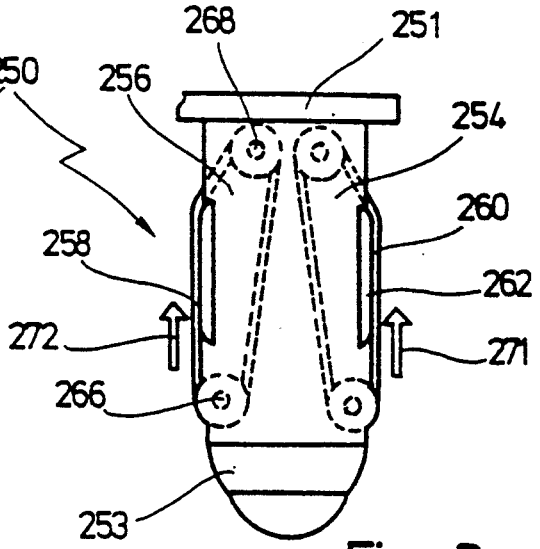
FIG. 3 shows an enlarged front view of a gathering fixture for pre-gathering the material.

The two gathering fixtures 250, which according to FIG. 1 are arranged next to one another and of which only one is depicted in FIGS. 3 and 4, each have two vertical plates 252 parallel to one another, which are fastened to a horizontal holder 251 and at their lower ends are connected by a shared blunt segment 253 that tapers downward slightly on all sides to make it easier to pull on a stocking leg.

Arranged between the two rectangular plates 252 are two belt drives 254, 256 that can be driven in opposite directions. The belt drives 254, 256 are implemented as double belt drives, with each two parallel belts being guided by a lower roller 266 and an upper roller 268. Arranged at the vertical edge segments of the plates 252 are guide rails 262, 264, over which the belts 258, 260 are guided so as to project outward beyond the end surfaces of the plates.

The two upper rollers 268 of the belt drives 254, 256 are offset towards the inside of the plates 252. Since the lower rollers 266, in contrast, are arranged at the edges of the plates 252, the result is that each belt drive 254, 256 is triangular, with the two upper limbs of the belt drives 254, 256 being inclined symmetrically towards the center of the plates 252.

As a result of this arrangement, a long, outwardly projecting stub segment is present at each edge of the two plates 252, creating good contact between the belts and a pair of tights that is being gathered up.

The belts have a round cross section, and are made of plastic that is preferably weldable.

When a pair of tights 100 is to be gathered up, its two legs are pulled manually onto the gathering fixtures 250, arranged next to one another at an appropriate .spacing at the feeder station 32, so that they are held on the two blunt segments 253. Once the two gathering fixtures 250 have been rotated to the stretching station 30, the tights 100 are completely gathered up by briefly operating the belt drives in the direction of the arrows 271, 272, so that they are held at the upper end beneath the holder 251.

Figure 5:
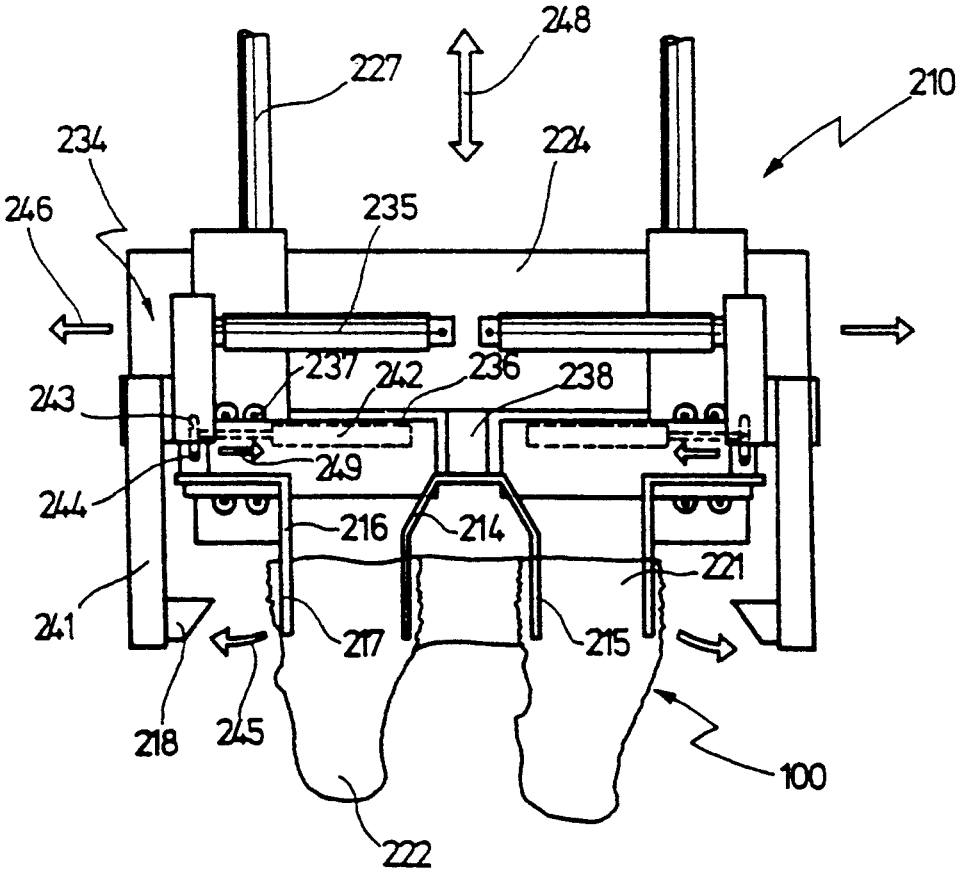
FIG. 5 shows a front view of a stretching apparatus for transferring the pre-gathered material from the gathering fixture.
Figure 6:
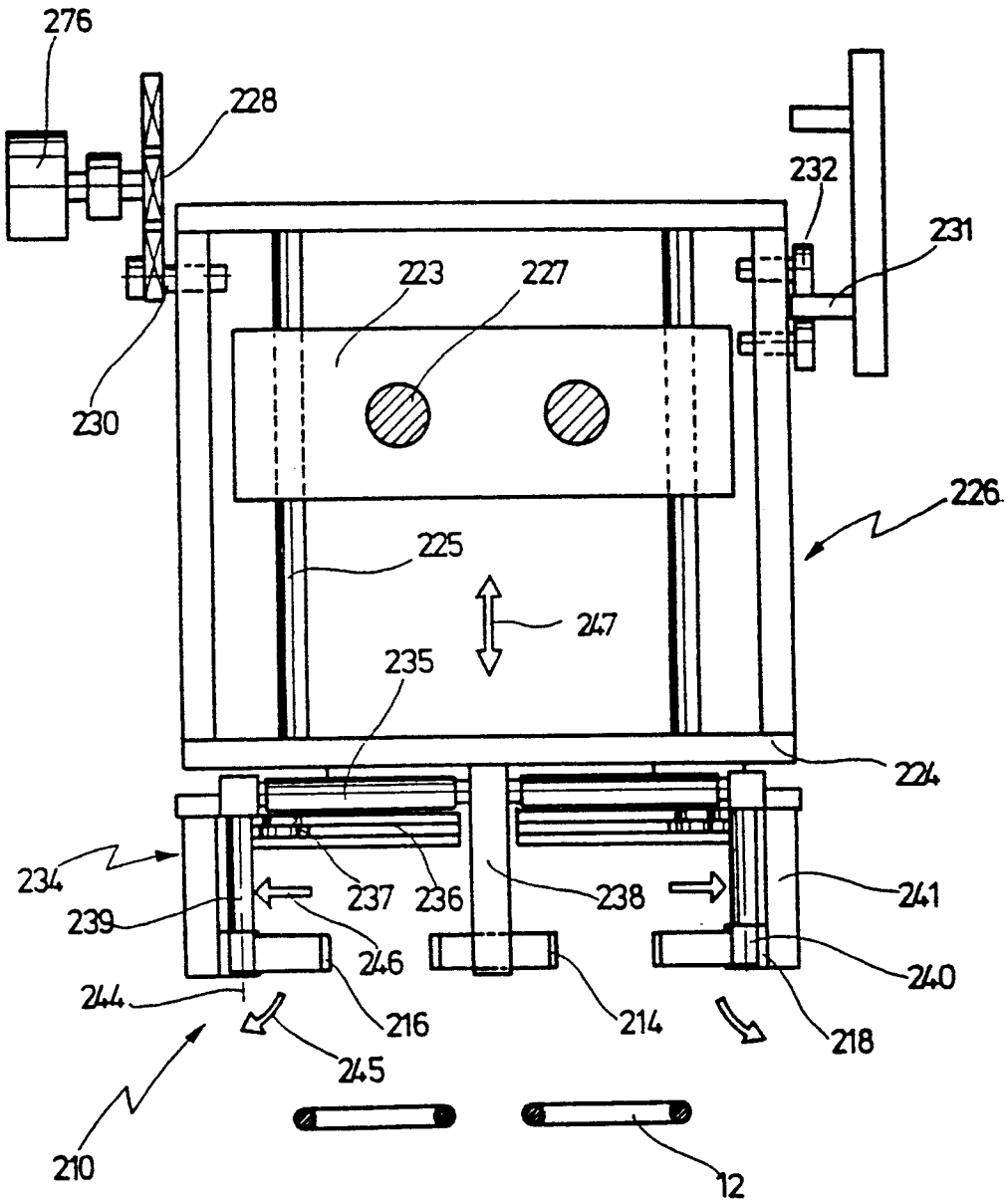
FIG. 6 shows a section through the stretching apparatus according to FIG. 5, from above, in a simplified depiction.
Figure 7:
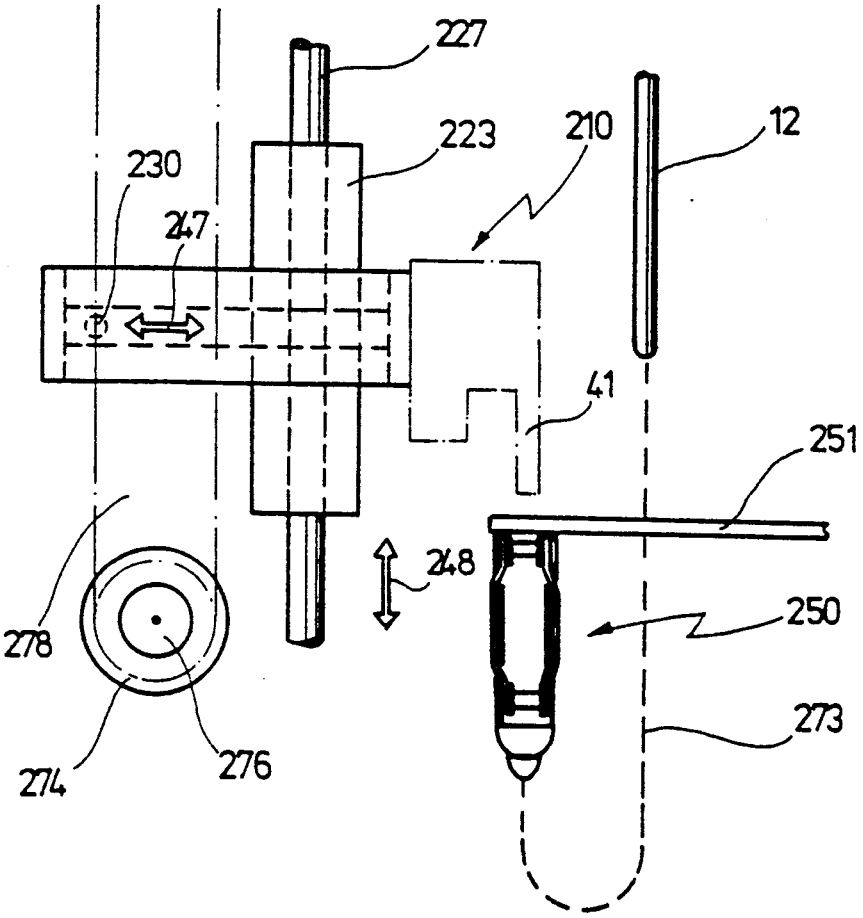
FIG. 7 shows a general sketch explaining the procedure for transferring the gathered material from the gathering fixture, and the slipping-on procedure.

The stretching apparatus labeled as a whole with the number 210 has, according to FIGS. 5 and 6, gripper elements 214, 216 that can travel vertically and horizontally, and additionally can be spread apart from one another in order to take tights 100 from the gathering fixtures 250 according to FIGS. 3 and 4, and then, beginning with the stocking legs, slip them onto two frames 12 arranged next to one another.

To allow the gripper elements to travel vertically and horizontally, a horizontally arranged chassis, labeled as a whole with the number 226 in FIG. 6, is provided. The chassis 226 can travel horizontally (arrow 247) on two parallel round bars 225 that are guided in a guide block 223. The guide block 223 is arranged in a vertically displaceable manner on two vertically arranged round bars 227 parallel to one another (arrow 248 in FIG. 5).

The gripper elements 214, 216 are fastened to a front vertically arranged base plate 224 that forms the front part of the horizontally displaceable chassis 226.

The chassis 226 can be displaced periodically vertically and horizontally by means of a vertical chain drive 228, since the chain drive has an endless chain, guided over an upper reversing pinion (not depicted) and a lower drive pinion 274, that is connected by means of a driver 230 to a side wall of the chassis 226. A drive unit 276 is provided to drive the chain drive 228. When the chain drive 228 is driven, the result is a closed curved trajectory 273 that is defined by the geometry of the chain drive 228 (see FIG. 7). The chassis 226 therefore moves alternately in the vertical direction, then simultaneously in the horizontal and vertical directions, until the driver 226 has passed completely around the upper or lower pinion of the chain drive 228; this is then followed in turn by a vertical movement that is opposite in direction to the first vertical movement, and lastly by another combined horizontal and vertical movement until the driver has completely passed around the other pinion.

In this manner the various required movements of the gripper elements 214, 216 can be generated relatively simply.

Arranged on the side of the chassis 226 opposite the chain drive 228, for additional guidance, is a guide rib 231 on which the chassis is guided by two followers 232.

In FIG. 5, the chassis and the chain drive are not depicted for the sake of clarity.

Fastened by means of a central holder 238 to the vertical base plate 224 of the chassis 226 is a rigid central gripper element 214 that is designed as a bow bent essentially into a U shape, the two parallel limbs of which form two gripper fingers 215 pointing vertically downward.

Arranged on either side of the rigid central gripper element 214 are two outer, tiltable gripper elements 216, each of which is arranged on a displacer unit 234 so it can be displaced outward away from the central gripper element 214 and tilted with respect to it. The two displacer units 234 arranged on either side of the central gripper element 214 can each be displaced horizontally outward away from the central gripper element 214 by means of horizontally arranged actuator cylinders 235, as indicated by the arrows 246. The displacer units 234 are each guided by means of guide rollers 237 on a horizontal guide 236. The gripper elements 216, which have an L-shaped cross section and of which each longer limb, which is designed as a gripper finger 217, points vertically downward as depicted in FIG. 5, are each fastened at the outer free end of a gripper shaft 239 that is configured as a square section 240.

The outer gripper elements 216 can be tilted by means of actuator cylinders 242 that act on rocker arms 243. Associated with the outer gripper elements 216 are stop elements 218 which are rigidly fastened by means of stop holders 241 to a respective displacer unit 234. The stop elements 218 are designed as rubber bumpers, and are suitably beveled at their surfaces facing the outer gripper elements 216, so that when the gripper elements 216 pivot outward in the direction of arrows 245 the gripper fingers 217 each make parallel contact with the stop elements 218.

In order to pivot the gripper elements 216 outward in the direction of arrows 245, the actuator cylinders 242 are moved inward in the direction of arrows 249, thus resulting in the desired tilting movement by means of the rocker arms 243.

If space considerations permit, the actuator cylinders 242 can of course also act below the rotation axis 244 of the tiltable gripper elements 216, so that the actuator cylinders can be extended outward in order to produce the desired outward tilting movement in the direction of arrows 245.

FIG. 5 schematically indicates a pair of tights 100 which have been taken in the gathered state from a gathering fixture 210 according to FIGS. 3 and 4, and is now held on the gripper elements 214, 216.

The tights 100 can now be pulled from bottom to top onto the frames 12 by means of the gripper elements 214, 216.

For this purpose, the outer gripper elements 216 are spread outward in the direction of arrows 246 and, during the relative movement between stretcher 212 and gripper elements 214, 216, are additionally tilted periodically against the stop elements 218, thus producing a gentle transfer from the gripper elements 214, 216 onto the frames 212. This also produces a loose, uniform stretching of the tights 100.

Once the tights 100 have been completely stretched on the frames 12, the carousel 16 is rotated further counterclockwise approximately 60 degrees, so that the frames 12, with the tights 100 stretched on them, are moved back to the feeder station 32 in from of the large-area light source 20, which is designed as a light box.

Figure 8:
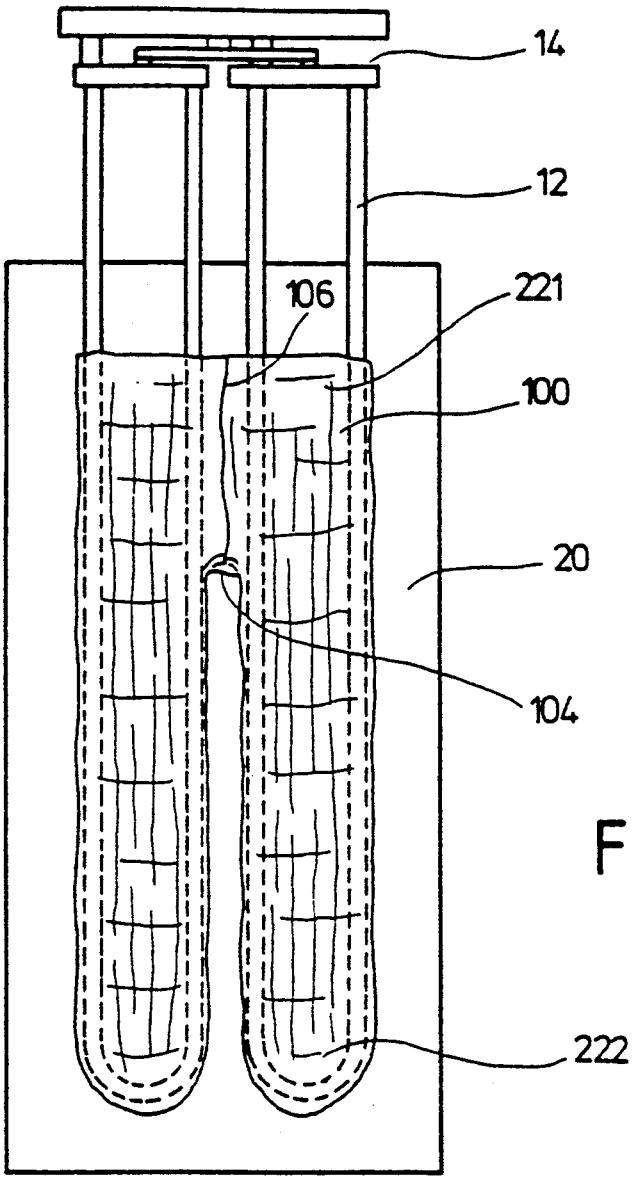
FIG. 8 shows an enlarged view of the frames with a stretched pair of tights at the feeder station, in front of a large-area light source for visual inspection.

In this position, which is also depicted in an enlarged and schematic manner in FIG. 8, the tights 100 are located above the gathering fixtures 250, which in the meantime have also been moved back to the feeder station 32 in order to feed in additional pairs of tights. In this position in front of the large-area light source 20, the tights 100 can therefore be subjected to a visual inspection for defects while at the same time additional pairs of tights are being pulled onto the gathering fixtures 250.

Figure 9:
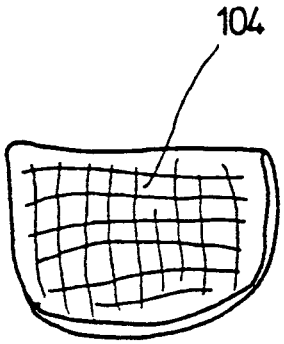
FIG. 9 shows the gusset according to FIG. 8, in an enlarged perspective depiction.

Indicated in the enlarged depiction according to FIG. 8, in the transition region between the two stocking legs, is the gusset 104, which is attached by means of a front seam 106 and a rear seam to the waistband of the tights 100. In the position in which the frames 12 are aligned with one another, the gusset 104 is not completely stretched out into shape, so that the fabric is wrinkled as is evident from the enlarged depiction according to FIG. 9.

Figure 10:
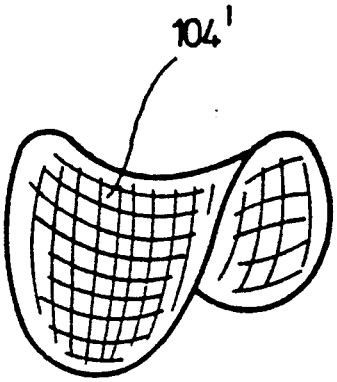
FIG. 10 shows the gusset in an enlarged perspective depiction, but after the two frames have been twisted into an offset arrangement according to FIG. 2.

For visual inspection, the two frames 12 are briefly pivoted with respect to one another by means of the frame receptacle 14 (in a manner not explained further) so that the gusset is three-dimensionally stretched into a saddle shape as indicated by the number 104' in FIG. 10. This position guarantees that a proper visual inspection can also be conducted in the gusset area. Once the visual inspection is complete, the frames 12 are pivoted back into an arrangement aligned with one another, and the carousel 16 is moved on through approximately 60 degrees counterclockwise, in the direction of arrow 27, to the first heating station 34. In the first heating station 34 and in the subsequent second heating station 36, the tights are acted upon by heat from infrared radiators so that they are briefly heated to a temperature of approximately 100 to 110 degrees C. Alternatively or additionally, hot air blowers can be provided for heating. This produces the desired relaxation of the previously wrinkled fabric, and the desired smoothing and, if necessary, drying of the tights.

From the second heating station 36, the tights pass, by means of a further rotation of the carousel 16, to the cooling station 38. In the cooling station 38, the tights are cooled by two radial blowers 39. The cooling station 38 can also be omitted if necessary.

Rapid cooling of the tights on the frames 12 prevents subsequent shrinkage and guarantees that the stockings will be very consistent as to size, and that they will lie completely flat after later being pulled off the frames.

A further rotation of the carousel through approximately 60 degrees brings the tights from the cooling station 38 to the pull-off station 40. As indicated in FIG. 11 by arrows 108, the frames 12 are first pivoted parallel to one another so that the stocking legs, stretched flat, are parallel to one another.

Figure 11:
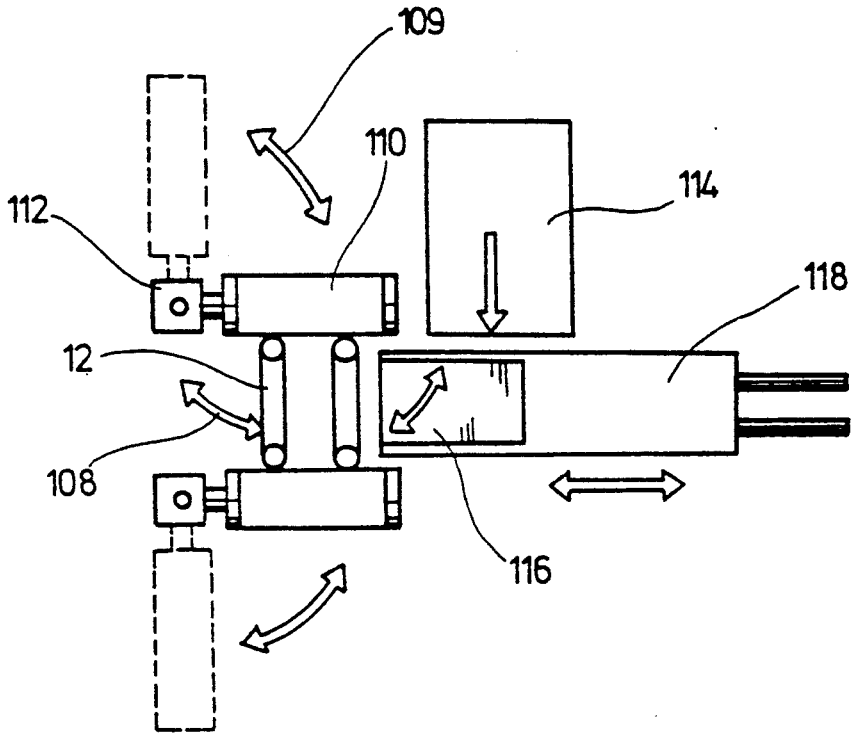
FIG. 11 shows a top view of the pull-off station, in an enlarged, simplified depiction.
Figure 12:
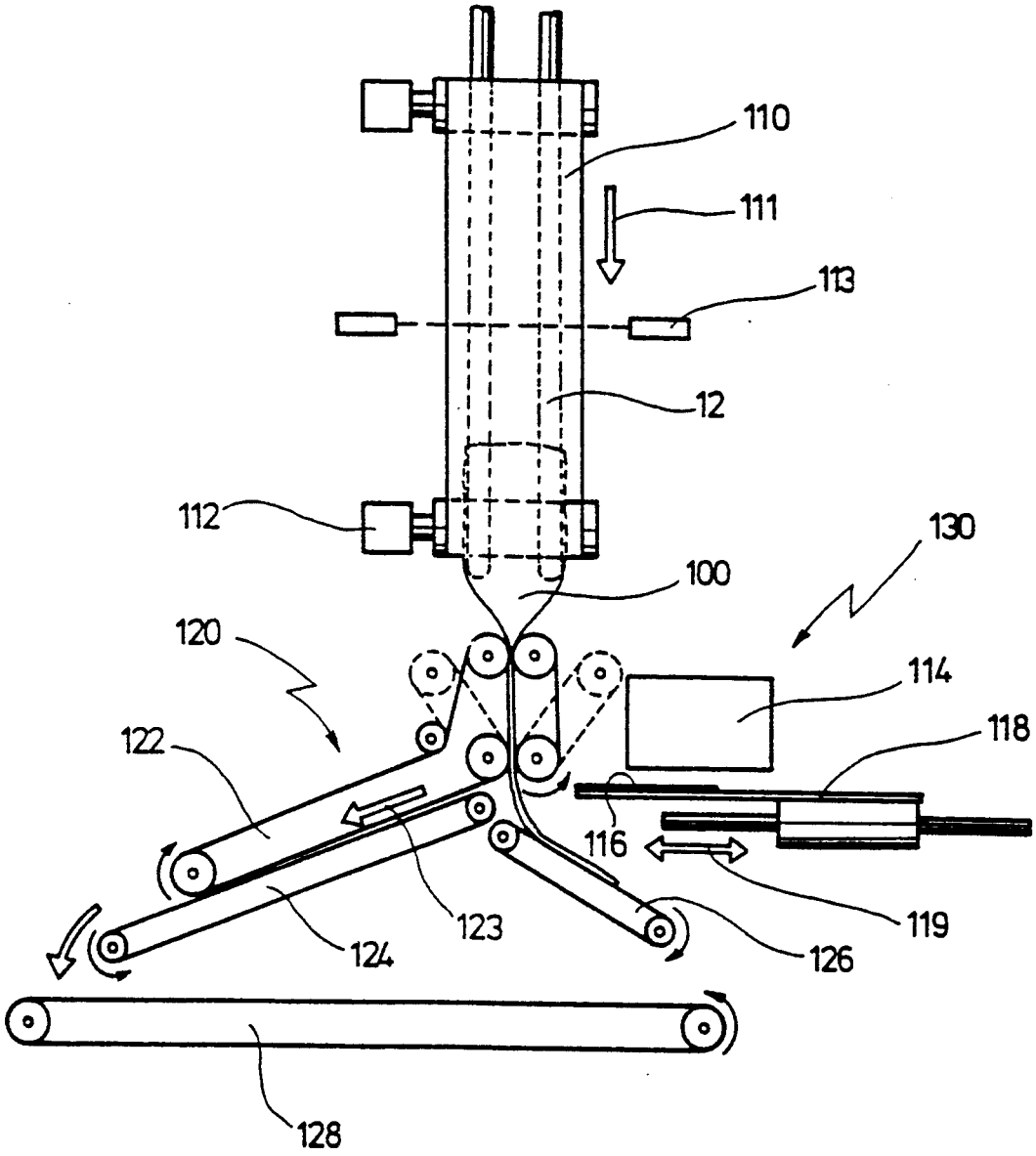
FIG. 12 shows a side view of the pull-off station in a schematic depiction.

In this position, two vertically arranged pull-off belts 110 are then pivoted laterally from a position indicated with dashed lines in FIG. 11, in the direction of arrows 109, against the narrow sides of the frames 12, resulting in the position depicted with solid lines in FIG. 11. To pivot the pull-off belts 110, the latter are each fastened to a pivot apparatus 112 which allows a 90-degree pivoting movement, with the lower pivot apparatus being combined with a drive.

The pull-off belts 110 in contact with the frames as shown in FIG. 11 are each driven in opposite directions, so that the tights 110, according to FIG. 13, are gently pulled vertically downward off the frames 12 in the direction of arrow 111. Arranged below the pull-off belts 110 is a folding apparatus for transverse folding of the tights, labeled as a whole with the number 120, which has a lateral package liner feeder that is labeled as a whole with the number 130.

The tights are transported farther downward by means of two belts, arranged vertically beneath the pull-off belts 110, which can be pivoted at their upper ends towards the center and parallel to one another. One of these two belts 122 is extended obliquely outward by means of a reversing roller. Arranged parallel to this portion of the belt is a further belt 124. A folding slider 118 is guided, in a horizontally displaceable manner, in the region between these two parallel belts 122, 124 that extend obliquely outward. The folding slider 118 can be displaced in the direction of arrow 119 as far as the initial region between the two parallel belts 122, 124, thus initiating transverse folding of the tights 100, the foot region of which is already lying on a further belt 126 that extends obliquely outward in a direction opposite to that of the parallel belts 122, 124.

In this connection, a package liner 116 can additionally be fed onto the top of the folding slider 118 from a package liner magazine 114 that is arranged above the folding slider 118. As the folding slider 118 advances, the package liner 116 is fed between the two parallel belts 122, 124 so that folding occurs around the front edge of the package liner 116.

Correct timing of folding and delivery of the package liner 116 is controlled by a photoelectric barrier 113 that delivers a switching signal as soon as the waistband of the tights 100 has passed the photoelectric barrier while being moved vertically by means of the pull-off belts 110.

Lastly, the tights 100 are pulled completely off the frames 12, pass outward in a transversely folded state in the direction of arrow 123, and fall onto a conveyor belt indicated by the number 128. From here, having been folded once, the tights 100 are moved to the downstream folding and packaging apparatus.

In an alternative embodiment, the folding and packaging apparatus can also be combined with the aforesaid folding apparatus 120.

What is claimed is:

1. A device for smoothing tubular, extensible material having at least one closed end, comprising:

at least one elongated stretcher for stretching said material thereon;

a gathering fixture adapted to receive said material for pre-gathering thereon;

transfer means for removing said pre-gathered material from said gathering fixture and for moving along said elongates stretcher in order to slip said pre-gathered material onto said stretcher, said transfer means including at least two gripper elements adapted to be inserted at least partly into said gathering fixture and movable away from one another when inserted in order to engage said pre-gathered material for removing said material from said gathering fixture and for stretching said material on said elongates stretcher as said transfer means is moved therealong; and heating means for heating said material on said stretcher.

2. A device according to claim 1, wherein said material is pregathered onto said gathering fixture in a non-stretched state.

3. A device according to claim 1, in which at least one gripper element is arranged tiltable with respect to another one of said gripper elements.

4. A device according to claim 3, wherein a stop element is provided adjacent each tiltable gripper element, and wherein said tiltable gripper elements can be tilted against said stop elements in order to hold said gathered material fixed therebetween, and to release said gathered material for transfer onto said stretcher when freed between said tiltable elements and said stop elements.

5. A device according to claim 4, in which each tiltable gripper element can be alternately tilted against said stop element and moved into a position parallel to said other gripper element, while said gripper elements are movable relative to and along said stretcher, in order to slip said gathered material onto said stretcher.

6. A device according to claim 5, in which actuating means are provided for tilting said gripper elements at a tilting frequency which can be controlled as a function of the relative velocity between said gripper elements and said elongated stretcher when said gripper elements are moved along said elongated stretcher.

7. A device according to claim 3, in the two outer gripper elements each having a gripper finger which is arranged in a tiltable manner on either side of a central, essentially U-shaped gripper element having two limbs which are configured as gripper fingers.

8. A device according to claim 4, in which each stop element is designed as a rubber bumper.

9. A device according to claim 1, in which said gathering fixture includes two plates spaced away from one another, and which further includes belt drives which are arranged between said two plates and each having an endless circulating belt projecting at least partially outward beyond said plates.

10. A device according to claim 9, in which said gathering fixture includes two double belt drives, each having two belts arranged parallel to one another, and wherein said belts of either one of said double belt drives are driven in a running direction opposite to a running direction of the two belts of the other one of said double belt drives.

11. A device according to claim 9, in which said gathering fixture further includes guide rails provided between said plates for guiding said belts so as to project in part outward beyond long-side end surfaces provided on said plates.

12. A device according to claim 1, wherein said stretcher has at least one frame bent essentially into a U-shape.

13. A device according to claim 1, including a carousel adapted for rotation about its vertical axis and supporting a plurality of stretchers, wherein said gathering fixture and said transfer means comprise a stretching station, and wherein said heating means comprise a heating station, with each of said stations arranged along said carousel, and wherein said carousel is adapted to transport said material from one station to another by rotation thereof.

14. A device according to claim 13, in which said heating station is followed by a pull-off station adapted to pull said material off said stretcher.

15. A device according to claim 12, in which said frames each have a rounded portion and are attached to said carousel with their rounded portion facing downward.

16. A device according to claim 13, wherein a light source is provided to illuminate said material stretched on said stretchers for optical inspection.

17. A device according to claim 13, wherein said frames are supported on said carousel by means of a frame receptacle allowing a pivot motion between a mutually aligned arrangement in which said frames are mutually aligned with a straight line arranged perpendicular to said frames and intersecting said frames and between an arrangement displaced laterally out of alignment.

18. A device according to claim 14, wherein said frames can be pivoted along a longitudinal axis thereof into a position parallel to one another in order to pull off said material, and wherein said pull-off station includes two pull-off belts which, in order to pull said material off said frames, can be brought laterally against said frames.

19. A device according to claim 18, wherein said pull-off belts are followed by a folding means adapted to fold said material transversely.

20. A device according to claim 19, wherein said folding means includes a folding slider which is insertable laterally between parallel belts thereof.

21. A device according to claim 19, wherein said folding means includes a package liner feeder adapted to feed in a package liner.

22. A device for smoothing tubular, extensible material having at least one closed end and comprising a hosiery article, said device comprising:

at least one elongated stretcher for stretching said material thereon;

a gathering fixture adapted to receive said material for pre-gathering thereon;

stretching means for stretching said material on said elongates stretcher, said stretching means including gripper elements adapted for receiving said pre-gathered material from said gathering fixture and for moving along said elongated stretcher in order to slip said pre-gathered material on said stretcher;

heating means for heating said material on said stretcher;

wherein:

said gripper elements are adapted to be inserted at least partly into said gathering fixture and to be spread out away from each other in order to receive said pregathered material;

at least one gripper is arranged tiltable with respect to another ne of said gripper elements;

a stop element is provided adjacent each tiltable gripper element; and said tiltable gripper elements can be tilted against said stop elements in order to hold said gathered material fixed therebetween, and to release said gathered material for transfer onto said stretcher when freed between said tiltable gripper elements and said stop elements.

23. A device for smoothing tubular, extensible material having at least one closed end and comprising a hosiery article, said device comprising:

a carousel adapted for rotation about its vertical axis and supporting a plurality of elongates stretchers for stretching said material thereon;

a feeder station, including gathering fixture for receiving said material and pre-gathering thereon;

a stretching station including stretching means for stretching said material on said elongated stretchers, said stretching means removing said pre-gathered material from said gathering fixtures and transferring said material onto said elongated stretchers;

a heating station including heating means for heating said material on said elongated stretchers;

wherein:

each of said stations is arranged along said carousel which is adapted to transport said material from one station to another by rotation thereof;

said gathering fixtures are arranged movable back and forth between said feeder station and said stretching station to permit transferring of material from said stretching means onto said elongated stretchers at said stretching station while said gathering fixtures are moved from said stretching station to said feeder station to receive new material.

24. A device according to claim 23, wherein said feeder station further includes a light source which is arranged above said gathering fixtures to allow for visual inspection of said material which is stretched on said elongated stretchers and illuminated by said light source simultaneously to feeding of new material to said gathering fixtures.

25. A device according to claim 24, wherein said stretchers comprise frames which are bent essentially into a U-shape.

26. A device according to claim 25, in which said frames are supported on said carousel by means of a frame receptacle allowing a pivot motion between a mutually aligned arrangement in which said frames are mutually aligned with a straight line arranged perpendicular to said frames and intersecting said frames and between an arrangement in which at least one of said frames is pivoted out of said straight line arrangement by a small angle to allow for a visual inspection of tightly stretched material.

27. A device of claim 23, wherein said stretching means includes gripper elements that are selectively moveable away from each other for engaging said pre-gathered material on said gathering fixtures.

* * * * *